US006910824B2

(12) United States Patent
Holland et al.

(10) Patent No.: US 6,910,824 B2
(45) Date of Patent: Jun. 28, 2005

(54) WRITING INSTRUMENT WITH FLUID-CONTAINING BARREL

(75) Inventors: Jason S. Holland, Raleigh, NC (US); Brenda S. Jones, Raleigh, NC (US); Ernest L. (Trey) Jones, III, Raleigh, NC (US)

(73) Assignee: Adstracts, Inc., Raleigh, NC (US)

( * ) Notice: Subject to any disclaimer, the term of this patent is extended or adjusted under 35 U.S.C. 154(b) by 0 days.

(21) Appl. No.: 10/624,155

(22) Filed: Jul. 21, 2003

(65) Prior Publication Data

US 2005/0019088 A1 Jan. 27, 2005

(51) Int. Cl.[7] ..... B43K 5/12; B43K 29/00
(52) U.S. Cl. ..... 401/192; 401/195
(58) Field of Search ..... 401/52, 195, 192; 40/334, 905

(56) References Cited

U.S. PATENT DOCUMENTS 2,237,883 A * 4/1941 Lipic ..... 40/334
2,272,139 A * 2/1942 Tapner ..... 401/52 X
2,304,522 A * 12/1942 Wuestman ..... 40/334
2,502,328 A * 3/1950 Kuhn ..... 40/334
5,673,996 A * 10/1997 Ducker ..... 401/195 X
5,913,629 A 6/1999 Hazzard ..... 401/33
6,062,753 A 5/2000 Hadtke et al. ..... 401/6
6,174,098 B1 1/2001 Yeh ..... 401/52
6,299,372 B1 * 10/2001 Wang ..... 401/195
D466,252 S 11/2002 Yu ..... D28/88
6,554,515 B2 4/2003 Debbas ..... 401/6

* cited by examiner

*Primary Examiner*—David J. Walczak
(74) *Attorney, Agent, or Firm*—Myers Bigel Sibley & Sajovec, P.A.

(57) ABSTRACT

A promotional writing instrument includes elongated first and second barrel portions. The second barrel portion is transparent and hollow and includes an open end and an opposite closed end. A fluid is disposed within the hollow second barrel portion and is viewable through the transparent second barrel portion. A plug seals the second barrel portion such that the fluid is prevented from escaping from the hollow second barrel portion. The plug is configured so as not to contact the inside surface of the first barrel portion even under flexure of the first and second barrel portions.

23 Claims, 4 Drawing Sheets

WRITING INSTRUMENT WITH FLUID-CONTAINING BARREL

FIELD OF THE INVENTION

The present invention relates generally to writing instruments and, more particularly, to writing instruments with decorative features.

BACKGROUND OF THE INVENTION

The use of promotional items has proliferated in today's increasingly competitive marketplace, where companies are constantly seeking more effective and new ways to market their products. In the healthcare industry, physicians and other healthcare providers often receive promotional articles from vendors of healthcare-related products, such as pharmaceutical products. These promotional articles often include "everyday" items, such as writing pads, calendars, and pens that have promotional information (indicia) printed thereon. For example, pharmaceutical companies often provide physicians with writing pens having the name of a particular pharmaceutical product printed thereon with the hopes that the pens will help remind the physicians to prescribe the particular pharmaceutical product.

Unfortunately, because of lack of distinctiveness, many promotional articles provided to healthcare providers often become "lost-in-the-shuffle" with other promotional articles. Thus, there is a need for distinctive, more effective promotional products directed to healthcare providers as well as to others.

SUMMARY OF THE INVENTION

In view of the above discussion, promotional writing instruments are provided. According to an embodiment of the present invention, a writing instrument includes elongated first and second barrel portions. The first barrel portion has an open first end through which a writing element is extendable, and an opposite open second end. The second barrel portion is transparent and hollow and includes an open end and an opposite closed end. The second barrel portion open end is secured within the second end of the first barrel portion. A fluid is disposed within the hollow second barrel portion and is viewable through the transparent second barrel portion. A plug seals the second barrel portion open end such that the fluid is prevented from escaping from the hollow second barrel portion.

The plug includes a shank and a head portion connected to the shank. The head portion extends radially outward from the shank to define a circumferential shoulder. When the shank is disposed within the open second end of the second barrel portion, the shoulder is in contacting relationship with the annular rim of the open second end. The plug head portion tapers radially inward such that the head portion does not contact the inside surface of the first barrel portion second end and such that flexure of the first and second barrel portions relative to one another does not cause the head portion to contact the inside surface of the first barrel portion second end. By avoiding contact, the plug remains undisturbed, thereby avoiding any loss of sealing ability.

According to other embodiments of the present invention, a light is configured to illuminate the fluid within the hollow second barrel portion in response to user activation. The light is powered via a power source (e.g., battery) disposed within the writing instrument and a user-activateable switch is located on the first barrel portion. The switch is responsive to user activation for switching the light on and off.

DETAILED DESCRIPTION OF THE INVENTION

Figure 1:
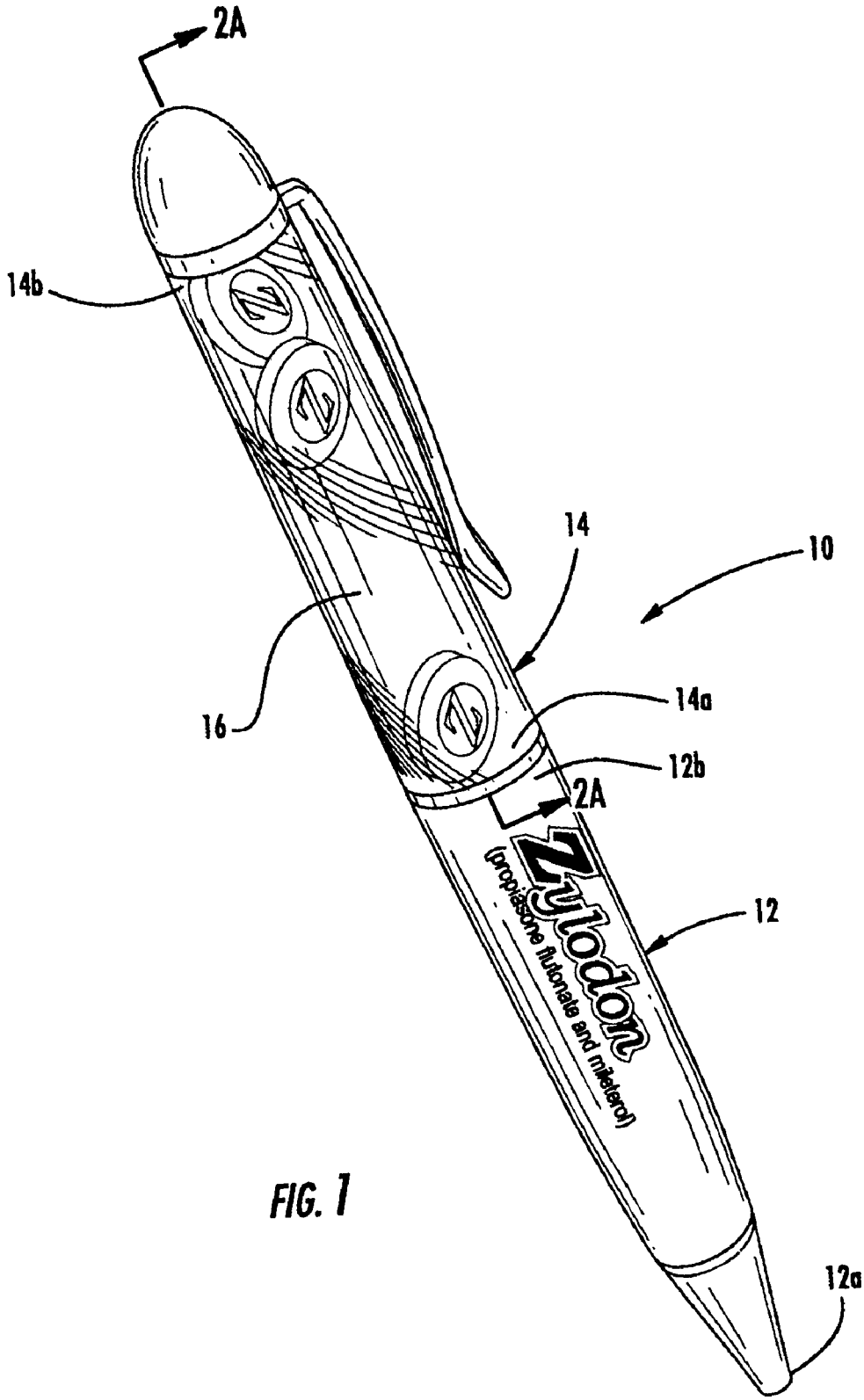
FIG. 1 is a perspective view of a writing instrument, according to an embodiment of the present invention.

The present invention now is described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

In the drawings, the thickness of lines, layers and regions may be exaggerated for clarity. It will be understood that when an element such as a layer, region, substrate, or panel is referred to as being "on" another element, it can be directly on the other element or intervening elements may also be present. In contrast, when an element is referred to as being "directly on" another element, there are no intervening elements present. It will be understood that when an element is referred to as being "connected" or "attached" to another element, it can be directly connected or attached to the other element or intervening elements may also be present. In contrast, when an element is referred to as being "directly connected" or "directly attached" to another element, there are no intervening elements present. The terms "upwardly", "downwardly", "vertical", "horizontal" and the like are used herein for the purpose of explanation only.

Referring now to FIG. 1, a writing instrument 10 according to an embodiment of the present invention is illustrated. The illustrated writing instrument 10 includes elongated first and second barrel portions 12, 14. The first barrel portion 12 has an open first end 12*a* and an open second end 12*b*. As would be understood by those of skill in the art, a writing element (not shown) is extended and retracted through the open first end 12*a*. Various types of writing elements (e.g., flair-tip writing elements, ball-point writing elements, etc.) may be utilized in accordance with embodiments of the present invention. Writing elements are well known to those of skill in the art, and will not be further described herein.

Embodiments of the present invention are not limited to a particular style of writing instrument or to a particular type of writing element.

The illustrated first and second barrel portions 12, 14 have generally cylindrical configurations. However, writing instruments according to embodiments of the present invention may have barrel portions with various other shapes and configurations, without limitation.

Figure 2A:
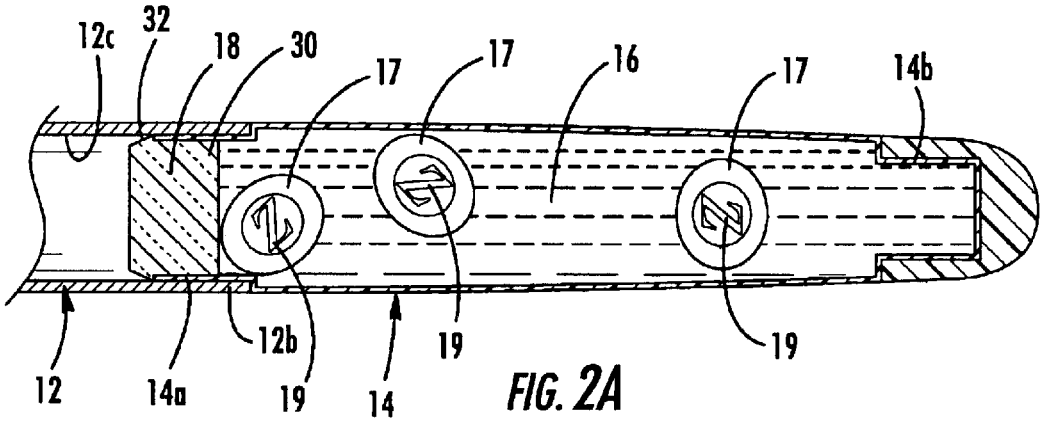
FIG. 2A is a cross-sectional view of the writing instrument of FIG. 1 taken along lines 2A-2A.
Figure 2B:
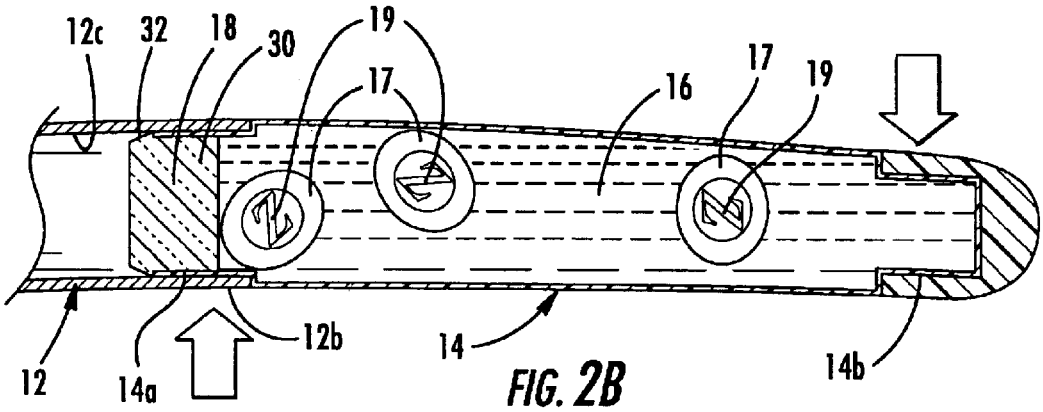
FIG. 2B illustrates the writing instrument of FIG. 2A being subjected to flexure.

The second barrel portion 14 is hollow and transparent, and includes an open end 14*a* and a closed end 14*b*. The transparent second barrel portion 14 may be formed from various transparent materials including, but not limited to, thermosetting polymers, thermoplastic polymers, glass, etc. A fluid 16 is disposed within the hollow second barrel portion 14, and is retained therein via a plug 18 that is secured within the open end 14*a*, as illustrated in FIGS. 2A–2B. In the illustrated embodiment, the fluid 16 is translucent. Exemplary translucent fluids which may be utilized include, but are not limited to, water, glycerin, mineral oil, etc. Preferably, a non-toxic, environmentally-neutral fluid is utilized for the fluid 16. According to embodiments of the present invention, the fluid 16 may have color and/or may be substantially opaque. Embodiments of the present invention are not limited to the use of translucent fluids.

Also disposed within the hollow second barrel portion 14 in the illustrated embodiment are a plurality of objects 17 which are configured to move through the translucent fluid 16 when the writing instrument 10 is inverted relative to horizontal. Movement of the objects within the translucent fluid 16 is viewable through the transparent second barrel portion 14.

In the illustrated embodiment, each of the objects 17 includes promotional indicia 19 displayed thereon. Various types of promotional indicia including, but not limited to, lettering, designs, characters, logos and other symbols, may be utilized in accordance with embodiments of the present invention. The term "lettering" as used herein includes, but is not limited to, alphabetical characters and alphanumeric characters.

Embodiments of the present invention are not limited to the configuration and size of the illustrated objects 17. Objects 17 may have any size, color, shape and the like depending on the overall appearance desired. In addition, various numbers of objects 17 may be utilized. Embodiments of the present invention are not limited to the illustrated number of objects 17. According to other embodiments of the present invention, the viscosity of the fluid and buoyancy of the objects 17 may be selected such that certain ones of the objects 17 ascend and/or descend within the fluid 16.

Figure 4:
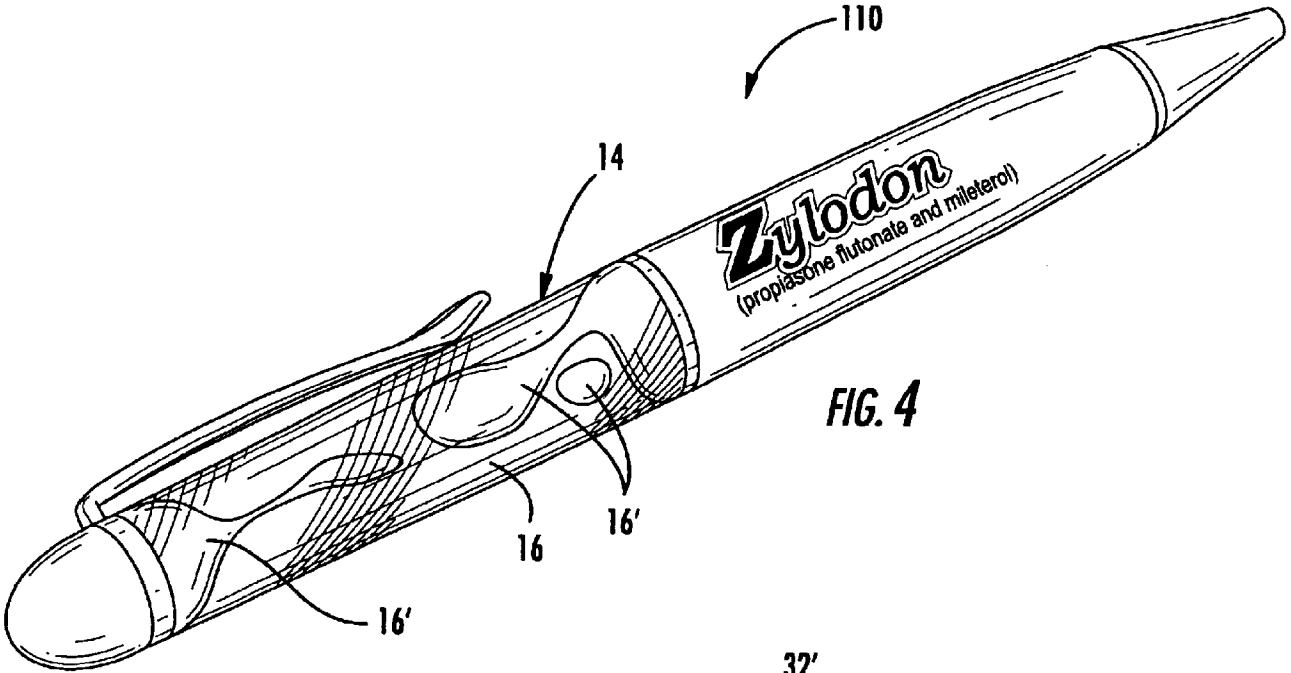
FIG. 4 is a perspective view of a writing instrument, according to another embodiment of the present invention, illustrating two fluids within the second barrel portion.

According to other embodiments of the present invention, two or more fluids may be disposed within the hollow second barrel portion 14. FIG. 4 illustrates two translucent fluids 16, 16' disposed within the hollow second barrel portion 14 of a writing instrument 110. The two translucent fluids 16, 16' may have respective viscosities that are substantially the same or substantially different. Moreover, the two translucent fluids 16, 16' may be clear or may have different colors. In the illustrated embodiment, the two fluids 16, 16' are substantially insoluble in each other.

Referring back to FIGS. 2A–2B, the illustrated open end 14*b* of the second barrel portion 14 has a generally cylindrical shape with an outside diameter $D_1$ that is slightly less than the outside diameter $D_2$ of the adjacent portion 14*c* of the second barrel portion 14, and slightly less than the inside diameter $D_3$ of the first barrel portion second end 12*b*. When assembled, the open end 14*a* of the second barrel portion 14 is inserted within and secured to the second end 12*b* of the first barrel portion 12.

The first and second barrel portions 12, 14 may be secured together in various ways, without limitation. For example, the open end 14*a* of the second barrel portion 14 may be adhesively secured within the second end 12*b* of the first barrel portion 12. The open end 14*a* of the second barrel portion 14 may be threadingly secured within the second end 12*b* of the first barrel portion 12. The open end 14*a* of the second barrel portion 14 may be press-fit within the second end 12*b* of the first barrel portion 12.

Figure 3:
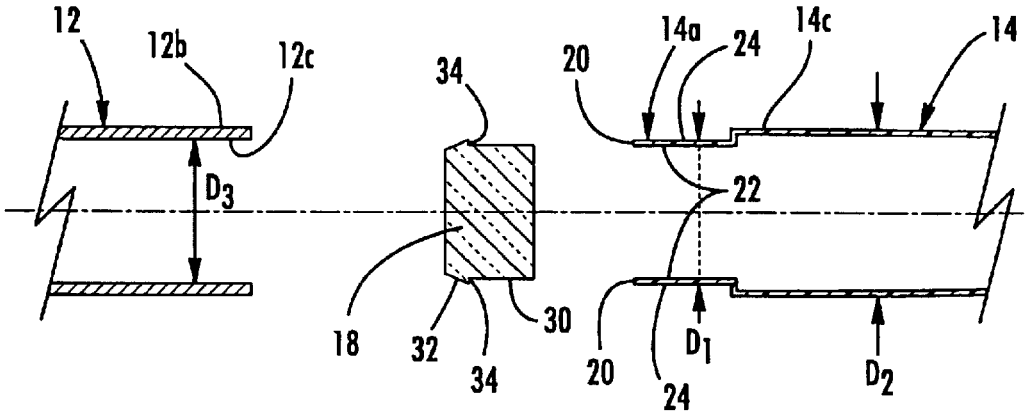
FIG. 3 is a partial, exploded view of the writing instrument of FIG. 1 illustrating the barrel end portions thereof and the plug for retaining fluid within the second barrel portion, according to embodiments of the present invention.

Referring to FIG. 3, the open end 14*a* of the second barrel portion 14 has an annular rim 20, an internal surface 22 and an external surface 24, as illustrated. The plug 18 includes a shank 30 and a head portion 32 connected to the shank 30. The head portion 32 extends radially outward from the shank 30 to define a circumferential shoulder 34. When the shank 30 is disposed within the open end 14*a*, the shoulder 34 is in contacting relationship with the annular rim 20 (FIGS. 2A–2B).

According to embodiments of the present invention, the second barrel portion 14 and the plug 18 are formed from polymeric material and the plug 18 is sonically welded to the second barrel portion open end 14*a*. Under sonic welding, the plug 18 and second barrel portion open end 14*a* are subjected to high-frequency sound waves which vibrate the polymeric material and cause friction, which results in high, focused heat. This heat melts or welds the plug 18 and second barrel portion open end 14*a* together. The process is very clean and allows for a strong, nearly unbreakable bond to be formed. Sonic welding is well understood by those skilled in the art and need not be described further herein. According to alternative embodiments, the plug 18 and second barrel portion open end 14*a* may be secured together via the use of an adhesive.

In the illustrated embodiment, the plug head portion 32 tapers radially inward such that the head portion 32 does not contact the inside surface 12*c* of the first barrel portion second end 12*b* and such that flexure of the first and second barrel portions 12, 14 relative to one another (as illustrated in FIG. 2B) does not cause the head portion 32 to contact the inside surface 12*c* of the first barrel portion second end 12*b*. The tapered configuration of the plug head portion 32 prevents contact with the inside surface 12*c* of the first barrel portion second end 12*b* even under such extreme bending.

By avoiding contact, the plug 18 remains undisturbed, thereby avoiding any loss of sealing ability. If the head portion 32 were to undergo a force from contact with the inside surface 12*c*, the plug 18 could become dislodged within the second barrel portion open end 14*a* which could enable some or all of the fluid 16 to escape from the second barrel portion 14, which would be undesirable.

Figure 5:
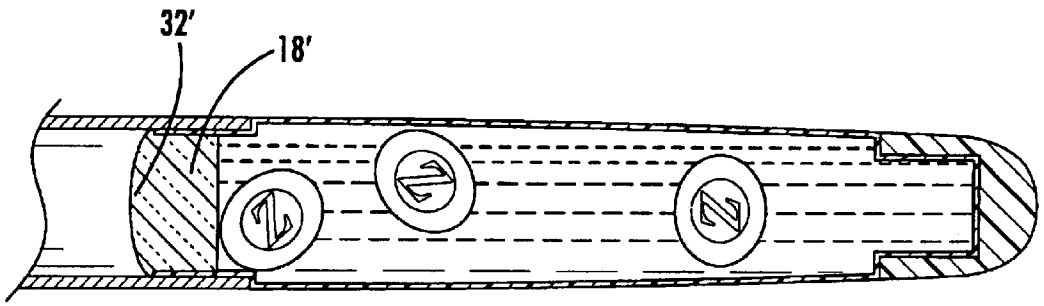
FIG. 5 is a cross-sectional view of the writing instrument of FIG. 1 taken along lines 2A—2A and illustrating a plug having a different head configuration.

The plug head portion 32 may have various radially-tapering configurations. For example, in FIG. 5, the plug head portion 32' has a rounded configuration.

Figure 6:
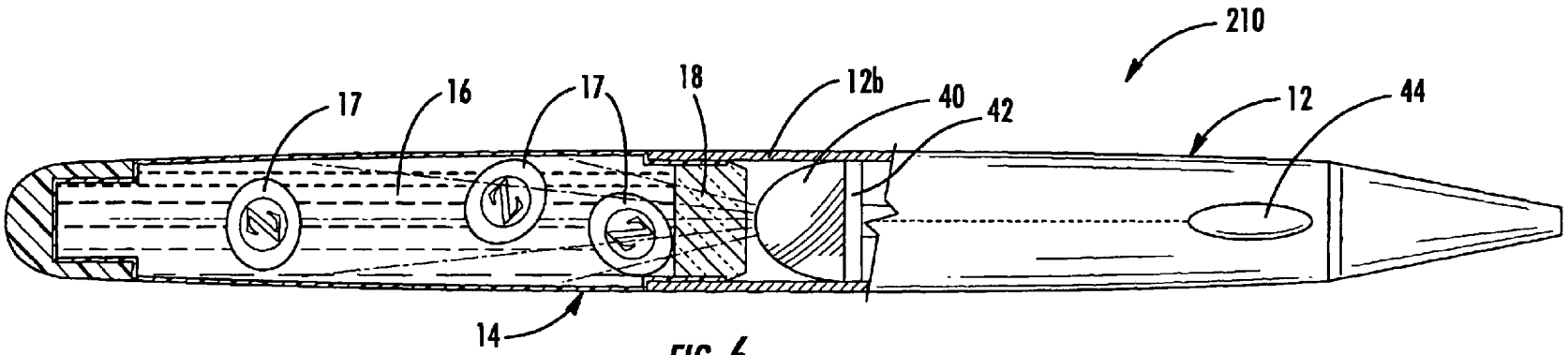
FIG. 6 is a cross-sectional view of a writing instrument, according to another embodiment of the present invention, illustrating a light that illuminates the fluid within the second barrel portion.

Referring to FIG. 6, according to other embodiments of the present invention, a writing instrument 210 includes a light 40 that is configured to illuminate the fluid 16 within the hollow second barrel portion 14. In the illustrated embodiment, the light 40 is disposed within the first barrel portion second end 12*b*. A power source (e.g., battery) 42 is disposed within the first barrel portion adjacent the light 40. A user-activateable switch 44 is located on the first barrel portion 12 and is in communication with the light 40 and power source 42. The switch 44 is responsive to user activation for switching the light 40 on and off. Various types of lights 40, power sources 42, and switched 44 may be utilized in accordance with embodiments of the present invention.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. The invention is defined by the following claims, with equivalents of the claims to be included therein.

What is claimed is:

1. A writing instrument, comprising:

an elongated first barrel portion that comprises an open first end through which a writing element is extendable, and an opposite open second end;

a transparent, hollow second barrel portion that comprises an open third end and an opposite fourth end, wherein the third end is secured within the second end of the first barrel portion, and wherein the third end has an annular rim, an internal surface and an external surface;

a fluid disposed within the hollow second barrel portion; and a plug disposed within the third end, wherein the plug prevents the fluid from escaping from the hollow second barrel portion, wherein the plug comprises a shank and a head portion connected to the shank, wherein the head portion extends radially outward from the shank to define a circumferential shoulder, wherein the shank is disposed within the third end and the shoulder is in contacting relationship with the annular rim, and wherein the head portion tapers radially inward such that the head portion does not contact an inside surface of the first barrel portion second end and such that flexure of the first and second barrel portions relative to one another does not cause the head portion to contact the inside surface of the first barrel portion second end.

2. The writing instrument of claim 1, wherein the third end is adhesively secured within the second end.

3. The writing instrument of claim 1, wherein the third end is threadingly secured within the second end.

4. The writing instrument of claim 1, wherein the second barrel portion and plug each comprise polymeric material and wherein the plug is sonically welded to the third end.

5. The writing instrument of claim 1, wherein the fluid is translucent, and further comprising at least one object disposed within the hollow second barrel portion, wherein the at least one object is configured to move through the translucent fluid when the writing instrument is inverted relative to horizontal, and wherein movement of the at least one object is viewable through the transparent second barrel portion.

6. The writing instrument of claim 5, wherein the at least one object is configured to be buoyant within the fluid.

7. The writing instrument of claim 5, wherein the at least one object comprises promotional indicia thereon.

8. The writing instrument of claim 1, further comprising a second fluid disposed within the hollow second barrel portion, and wherein the two fluids are insoluble in each other.

9. The writing instrument of claim 1, further comprising a light configured to illuminate the fluid within the hollow second barrel portion.

10. The writing instrument of claim 9, wherein the light is disposed within the first barrel portion second end.

11. The writing instrument of claim 9, further comprising:

a power source; and a switch in communication with the light and power source, wherein the switch is responsive to user activation for switching the light on and off.

12. A writing instrument, comprising:

an elongated first barrel portion that comprises an open first end through which a writing element is extendable, and an opposite open second end;

a transparent, hollow second barrel portion that comprises an open third end and an opposite fourth end, wherein the third end is secured within the second end of the first barrel portion, and wherein the third end has an annular rim, an internal surface and an external surface;

a translucent fluid disposed within the hollow second barrel portion;

at least one object disposed within the hollow second barrel portion, wherein the at least one object is configured to move through the translucent fluid when the writing instrument is inverted relative to horizontal, and wherein movement of the at least one object within the fluid is viewable through the transparent second barrel portion;

a plug disposed within the third end, wherein the plug prevents the fluid from escaping from the hollow second barrel portion, wherein the plug comprises a shank and a head portion connected to the shank, wherein the head portion extends radially outward from the shank to define a circumferential shoulder, wherein the shank is disposed within the third end and the shoulder is in contacting relationship with the annular rim, and wherein the head portion tapers radially inward such that the head portion does not contact an inside surface of the first barrel portion second end and such that flexure of the first and second barrel portions relative to one another does not cause the head portion to contact the inside surface of the first barrel portion second end; and a light configured to illuminate the fluid within the hollow second barrel portion.

13. The writing instrument of claim 12, wherein the at least one object is configured to be buoyant within the fluid.

14. The writing instrument of claim 12, wherein the at least one object comprises promotional indicia thereon.

15. The writing instrument of claim 12, further comprising a second fluid disposed within the hollow second barrel portion, and wherein the two fluids are insoluble in each other.

16. The writing instrument of claim 12, wherein the light is disposed within the first barrel portion second end.

17. The writing instrument of claim 12, further comprising:

a power source; and a switch in communication with the light and power source, wherein the switch is responsive to user activation for switching the light on and off.

18. A writing instrument, comprising:

an elongated first barrel portion that comprises an open first end through which a writing element is extendable, and an opposite open second end;

a transparent, hollow second barrel portion that comprises an open third end and an opposite fourth end, wherein the third end is secured within the second end of the first barrel portion, and wherein the third end has an annular rim, an internal surface and an external surface;

a translucent fluid disposed within the hollow second barrel portion;

a plug disposed within the third end, wherein the plug comprises a shank and a head portion connected to the shank, wherein the head portion extends radially outward from the shank to define a circumferential shoulder, wherein the shank is disposed within the third end and the shoulder is in contacting relationship with the annular rim, and wherein the bead portion tapers radially inward such that the head portion does not contact an inside surface of the first barrel portion second end and such that flexure of the first and second barrel portions relative to one another does not cause the head portion to contact the inside surface of the first barrel portion second end;

a light configured to illuminate the fluid within the hollow second barrel portion, wherein the light is disposed within the first barrel portion second end;

a power source; and a switch in communication with the light and power source, wherein the switch is responsive to user activation for switching the light on and off.

19. The writing instrument of claim 18, wherein the second barrel portion and plug each comprise polymeric material and wherein the plug is sonically welded to the third end.

20. The writing instrument of claim 18, wherein the fluid is translucent, and further comprising at least one object disposed within the hollow second barrel portion, wherein the at least one object is configured to move through the translucent fluid when the writing instrument is inverted relative to horizontal, and wherein movement of the at least one object is viewable through the transparent second barrel portion.

21. The writing instrument of claim 20, wherein the at least one object is configured to be buoyant within the fluid.

22. The writing instrument of claim 20, wherein the at least one object comprises promotional indicia thereon.

23. The writing instrument of claim 18, further comprising a second fluid disposed within the hollow second barrel portion, and wherein the two fluids are insoluble in each other.

* * * * *